US010964449B2

(12) United States Patent
Ashihara et al.

(10) Patent No.: US 10,964,449 B2
(45) Date of Patent: Mar. 30, 2021

(54) RESIN COMPOSITION, INSULATED ELECTRIC WIRE AND METHOD OF MANUFACTURING INSULATED ELECTRIC WIRE

(71) Applicant: Hitachi Metals, Ltd., Tokyo (JP)

(72) Inventors: Shingo Ashihara, Tokyo (JP); Hirotaka Yasaki, Tokyo (JP); Takashi Aoyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/738,168

(22) Filed: Jan. 9, 2020

(65) Prior Publication Data

US 2020/0227185 A1 Jul. 16, 2020

(30) Foreign Application Priority Data

Jan. 10, 2019 (JP) ..... JP2019-002475
Dec. 24, 2019 (JP) ..... JP2019-232223

(51) Int. Cl.
*H01B 7/295* (2006.01)
*H01B 13/06* (2006.01)
*H01B 3/30* (2006.01)

(52) U.S. Cl.
CPC ..... *H01B 7/295* (2013.01); *H01B 3/308* (2013.01); *H01B 13/06* (2013.01)

(58) Field of Classification Search
CPC . H01B 7/02; H01B 7/04; H01B 7/295; H01B 13/02; H01B 13/04; H01B 13/308; H01B 13/06
USPC ..... 174/110 R–110 PM, 110 SC
See application file for complete search history.

(56) References Cited

U.S. PATENT DOCUMENTS

2009/0020311 A1* 1/2009 Park ..... C08L 31/04 174/110 SR
2009/0090536 A1* 4/2009 Park ..... H01B 7/295 174/113 C
2009/0292061 A1* 11/2009 Kitano ..... C08F 287/00 524/505

FOREIGN PATENT DOCUMENTS

JP 2002324440 A 11/2002

* cited by examiner

*Primary Examiner* — William H. Mayo, III
(74) *Attorney, Agent, or Firm* — McCormick, Paulding & Huber PLLC

(57) ABSTRACT

An insulated electric wire includes a conductor and an insulating layer coated in periphery of the conductor. The insulating layer is made of a resin composition containing a base polymer and a flame retardant. The flame retardant is made of silane-treated aluminum hydroxide, aluminum hydroxide treated with a treatment agent other than a silane coupling agent and/or untreated aluminum hydroxide. The base polymer contains a polymer having a polar group. The resin composition contains the flame retardant, a content of which is more than 40 parts by mass and equal to or less than 80 parts by mass per 100 parts by mass of the base polymer. The resin composition contains the silane-treated aluminum hydroxide, a content of which is equal to or more than 10 parts by mass and equal to or less than 70 parts by mass per 100 parts by mass of the flame retardant.

10 Claims, 2 Drawing Sheets

Figure 1:
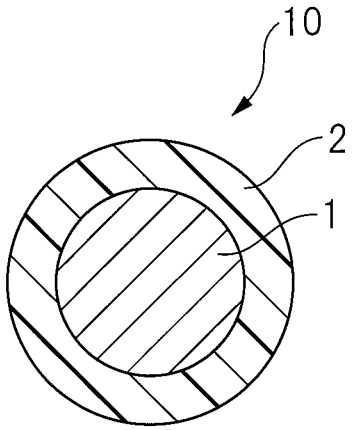

RESIN COMPOSITION, INSULATED ELECTRIC WIRE AND METHOD OF MANUFACTURING INSULATED ELECTRIC WIRE

CROSS-REFERENCE TO RELATED APPLICATION

The present application claims priority from Japanese Patent Application No. 2019-002475 filed on Jan. 10, 2019, and Japanese Patent Application No. 2019-232223 filed on Dec. 24, 2019, the contents of which are hereby incorporated by reference into this application.

TECHNICAL FIELD OF THE INVENTION

The present invention relates to a resin composition, an insulated electric wire and a method of manufacturing the insulated electric wire.

BACKGROUND OF THE INVENTION

An insulated electric wire (electric wire) includes a conductor and an insulating layer (coating substance) arranged in periphery of the conductor. This insulating layer is made of a resin composition (electrically-insulating material) containing rubber or resin as a main raw material. In recent years, in consideration of environmental problems, insulated electric wires (each referred to below as non-halogen insulated electric wire) each having an insulating layer made of a non-halogen resin composition not containing a halogen element such as fluorine, chlorine and bromine that have possibility of occurrence of toxic gas at the time of burning have been widely used. Particularly, it is preferable to use such a non-halogen insulated electric wire as an in-board wiring of a distribution board/control board or a motor lead wire having a relatively high possibility of touching of a person.

The non-halogen resin composition generally has a low flame retardancy, and therefore, is often used so that a frame retardant is added to itself. For example, a Japanese Patent Application Laid-Open Publication No. 2002-324440 (Patent Document 1) descries an electric wire or others having an insulating layer made of a resin containing a non-halogen frame retardant such as magnesium hydroxide.

SUMMARY OF THE INVENTION

Here, matters studied by the present inventors will be described. A method of manufacturing an insulated electric wire includes, for example, a step of forming an insulating layer (referred to below as insulating-layer coating step) by extruding a resin composition so as to coat periphery of a conductor. Generally, for providing properties such as flexibility (bendability) and heat resistance to the insulating layer of the insulated electric wire, a cross linking step that chemically couples molecules contained in the resin composition is necessary. As the method of manufacturing the insulated electric wire, two modes of (1) an in-line cross linking mode that performs an in-line cross linking step after the insulating-layer coating step, and then, reels up the insulated electric wire onto a drum and (2) a post cross linking mode that reels up an uncross-linked insulating layer onto the drum after the insulating-layer coating step, and then, performs the cross linking step at a different later step are conceivable.

To (1) the in-line cross linking mode, a cross linking method at a high temperature and a high pressure caused by filling a cross-linked pipe that is connected to an extruder with high-pressure steam is generally applied. Because of the high-pressure atmosphere, it is desirable to arrange a separator between the conductor and the insulating layer in order to prevent infiltration of the resin composition into the conductor. On the other hand, to (2) the post cross linking mode, a cross linking method without necessity of, for example, high pressure such as electron-beam irradiation is generally applied. Therefore, the possibility of the infiltration of the resin composition into the conductor is low, and thus, it is unnecessary to arrange the separator. Therefore, in viewpoints of reduction in a manufacturing cost of the insulated electric wire and efficiency of a wiring operation, (2) the post cross linking mode that can manufacture a so-called separator-less insulated electric wire is preferable.

And, as the cross linking method for use in (2) the post cross linking mode, for example, an electron-beam irradiation method and a silane cross linking method are exemplified. Particularly, the electron-beam radiation method is applicable to cross linking of almost all resin compositions, and can be also relatively simplified in terms of a blend composition of the resin composition, and therefore, is preferable.

However, the present inventors have verified the following problems related to (2) the post cross linking mode. When the electron-beam irradiation method is applied to (2) the post cross linking mode, generally, the insulated electric wire is reeled up on the drum or others once after the insulating-layer coating step, and then, the insulated electric wire is reeled out of the drum at a different step, and this insulated electric wire is irradiated with electron beam. In this case, when a surface of the uncross-linked insulated electric wire chafes against the drum (see a drum 29 shown in FIG. 2 and described later) or a jig such as a pulley for use in feeding the insulted electric wire or when the electrics wires chafe against each other, the electric wire is scratched or whitened. This results in a problem of degradation of outer appearance of the insulated electric wire.

This problem is also caused in the case of application of the silane cross linking method instead of the electron-beam irradiation method. This is because the silane cross linking method is common in the reeling up of the uncross-linked insulated electric wire onto the drum or others because of advancing the cross linking using moisture in air after the uncross-linked insulated electric wire is reeled up onto the drum or others.

In order to solve such a problem, it is necessary to study a blend composition of the resin composition, and, at the same time, it is essential to secure, for example, the flame retardancy and the flexibility in the insulating layer of the insulated electric wire that are required for use in an in-board wiring of a distribution board/control board, a motor lead wire or others.

The present invention has been made in consideration of such a problem, and an object of the present invention is to provide a resin composition and an insulated electric wire each of which has excellent whitening resistance, flame retardancy and flexibility in an uncross-linked state.

The summary of the typical aspects of the inventions disclosed in the present application will be briefly described as follows.

[1] A resin composition contains a base polymer and a flame retardant. The flame retardant is made of aluminum hydroxide, a surface of which is treated with a silane coupling agent, aluminum hydroxide, a surface of which is treated with a treatment agent other than the silane coupling agent and/or aluminum hydroxide, a surface of which is untreated. The base polymer contains a polymer having a polar group. The resin composition contains the flame retardant, a content of which is more than 40 parts by mass and equal to or less than 80 parts by mass per 100 parts by mass of the base polymer. The resin composition contains the aluminum hydroxide, a surface of which is treated with the silane coupling agent and a content of which is equal to or more than 10 parts by mass and equal to or less than 70 parts by mass per 100 parts by mass of the flame retardant.

[2] In the resin composition described in the item [1], the polymer having the polar group is ethylene-vinyl acetate copolymer.

[3] In the resin composition described in the item [1] or [2], the resin composition further contains a black, yellow, white, red or green colorant.

[4] An insulated electric wire including an insulating layer made of the resin composition described in any one of the items [1] to [3].

[5] A cable including a sheath layer made of the resin composition described in any one of the items [1] to [3].

[6] In the insulated electric wire described in the item [4], an oxygen index is equal to or larger than 20, and a tensile strength in 100% tension is equal to or smaller than 6.0 MPa.

[7] In the insulated electric wire described in the item [4], the insulated electric wire is used for an in-board wiring of a distribution board or a control board or for a motor lead wire.

[8] A method of manufacturing an insulated electric wire includes (a) a step of forming a resin composition by kneading a base polymer and a flame retardant, (b) a step of manufacturing an uncross-linked insulated electric wire by extruding the resin composition so as to coat periphery of a conductor to form an insulating layer, and (c) a step of manufacturing a cross-linked insulated electric wire by cross-linking the base polymer in the resin composition. The flame retardant is made of aluminum hydroxide, a surface of which is treated with a silane coupling agent, aluminum hydroxide, a surface of which is treated with a treatment agent other than the silane coupling agent and/or aluminum hydroxide, a surface of which is untreated. The base polymer contains a polymer having a polar group. The resin composition contains the flame retardant, a content of which is more than 40 parts by mass and equal to or less than 80 parts by mass per 100 parts by mass of the base polymer. The resin composition contains the aluminum hydroxide, a surface of which is treated with the silane coupling agent and a content of which is equal to or more than 10 parts by mass and equal to or less than 70 parts by mass per 100 parts by mass of the flame retardant.

[9] The method of manufacturing the insulated electric wire described in the item [8], the method includes (d) a step of reeling up the uncross-linked insulated electric wire after the step (b) and before the step (c).

[10] The method of manufacturing the insulated electric wire described in the item [8] or [9], an oxygen index of the cross-linked insulated electric wire is equal to or larger than 20, and a tensile strength in 100% tension of the same is equal to or smaller than 6.0 MPa.

According to the present invention, a resin composition and an insulated electric wire each of which has excellent whitening resistance, flame retardancy and flexibility in an uncross-linked state can be provided.

BRIEF DESCRIPTIONS OF THE DRAWINGS

Figure 2:
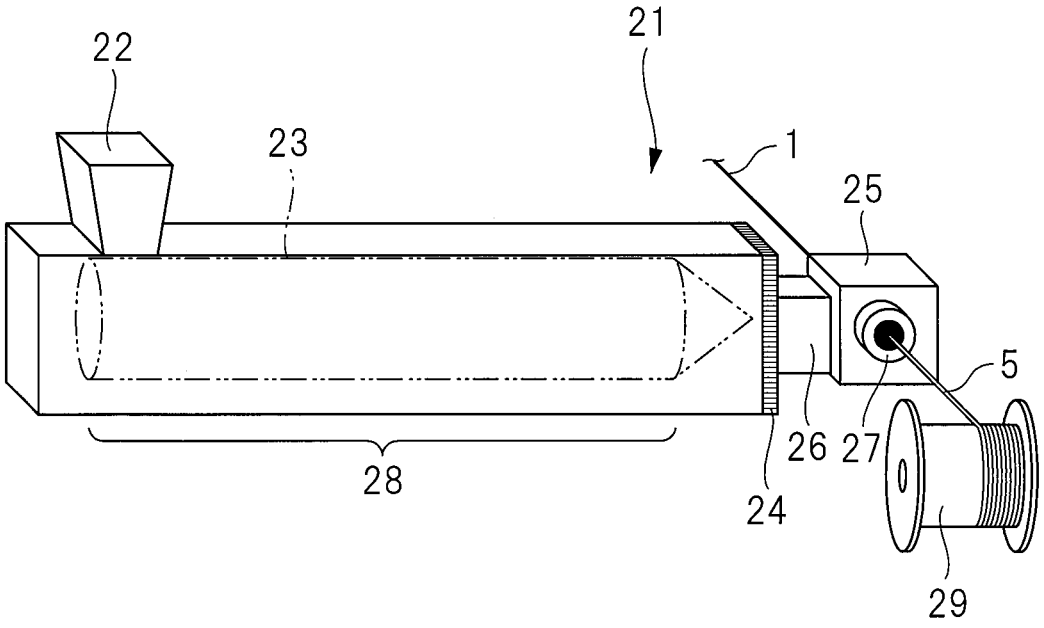

FIG. 1 is a horizontal cross-sectional view showing a structure of an insulated electric wire of an embodiment; and FIG. 2 is a schematic view showing an extrusion coating apparatus that manufactures the insulated electric wire of the embodiment.

DESCRIPTIONS OF THE PREFERRED EMBODIMENTS (Embodiment)

<Configuration of Resin Composition>

A resin composition (non-halogen resin composition, flame-retardant resin composition) according to an embodiment of the present invention contains (A) a base polymer and (B) a flame retardant. The (A) base polymer contains (A1) a polymer having a polar group. As the (A1) polymer having the polar group, ethylene-vinyl acetate copolymer, ethylene-acrylic acid copolymer and ethylene-acrylate copolymer are exemplified, and the ethylene-vinyl acetate copolymer is preferably used.

To (A1) the polymer having the polar group, individual use of the ethylene-vinyl acetate copolymer may be applied. However, as described later in working examples, it is preferable to blend two or more types of the ethylene-vinyl acetate copolymer. In this case, when a vinyl acetate content (VA amount) of the ethylene-vinyl acetate copolymer is large, a glass transformation temperature becomes high, and a low-temperature property becomes low. On the other hand, when the vinyl acetate content of the ethylene-vinyl acetate copolymer is small, polarity becomes low, and a fuel resistance property becomes low. Therefore, when the polymer contains two or more types of the ethylene-vinyl acetate copolymer that are different from one another in a vinyl-acetate content ratio, a resin composition having excellent balance between the low-temperature property and the fuel resistance property can be manufactured. In the working examples described later, note that ethylene-vinyl acetate copolymer having a vinyl acetate content (VA amount) of 15 mass % (weight %) and ethylene-vinyl acetate copolymer having a vinyl acetate content (VA amount) of 28 mass % (weight %) are used.

The (A) base polymer contains (A2) other polymer in addition to (A1) the polymer having the polar group. As (A2) the other polymer, a mixture of at least one or more types of ethylene-based copolymer selected from a group consisting of polyethylene, polypropylene, ethylene-(α-olefin) copolymer, a ternary copolymer that has been further added with a monomer such as ethylene-propylene-diene copolymer or modified substances (such as a silane-compound copolymerized or graft-polymerized substance, or a maleic-acid modified substance) of these materials, etc., is exemplified.

In the working examples described later, as (A2) the other polymer, the ethylene-(α-olefin) copolymer is used. As the ethylene-(α-olefin) copolymer, ethylene-propylene copolymer, ethylene-butene copolymer, ethylene-pentene copolymer, ethylene-hexene copolymer, ethylene-heptene copolymer, ethylene-octene copolymer and others are exemplified, and the ethylene-butene copolymer is preferably used as the other polymer.

The (B) flame retardant of the present embodiment is made of (B1) aluminum hydroxide, a surface of which is treated with a silane coupling agent, (B2) aluminum hydroxide, a surface of which is treated with a treatment agent other than the silane coupling agent and/or (B3) aluminum hydroxide, a surface of which is untreated.

A silane coupling agent is an organic silicon compound having an unsaturated bond group and a hydrolytic silane group. As the silane coupling agent, for example, γ-methacryloyloxy propyl trimethoxy silane, n-hexadecyl trimethoxy silane, γ-glycidoxy propyl trimethoxy silane, vinyl triacetoxy silane, γ-ureido propyl triethoxy silane, γ-dibutyl aminopropyl trimethoxy silane, γ-diallyl aminopropyl trimethoxy silane and others are exemplified. The aluminum hydroxide, a surface of which is treated with the silane coupling agent, according to the present embodiment can be manufactured by, for example, spray or immersion of aluminum hydroxide to solution of the silane coupling agent, and then, dry of them.

As other treatment agent than the silane coupling agent, fatty acid such as stearic acid, fatty-acid metal salt such as calcium stearate, titanate-based coupling agent and others are exemplified. A plurality of types of these treatment agents may be used in combination.

The resin composition of the present embodiment may contain not only (A) the base polymer and (B) the flame retardant but also (C) cross linking aid, (D) antioxidant, (E) copper inhibitor, (F) lubricant, (G) colorant or others if needed. As (C) the cross linking aid, for example, trimethylol propane trimethacrylate (TMPT), triallyl isocyanurate, triallyl cyanurate, N, N'-meta phenylene bis maleimide, ethylene glycol dimethacrylate, zinc acrylate, zinc methacrylate and others are exemplified. As (D) the antioxidant, for example, phenol-based antioxidant, sulfur-based antioxidant, phenol/thioester-based antioxidant, amine-based antioxidant, phosphite ester-based antioxidant and others are exemplified. As (E) the copper inhibitor, for example, hydrazides such as N'1, N'12-bis(2-hydroxybenzoyl) dodecane dihydrazide, N, N'-bis[3-(3,5-di-tert-butyl-4-hydroxyphenyl) propionyl] hydrazine and isophthalic acid bis(2-phenoxy propionyl hydrazine), 2-hydroxy-N-1H-1,2,4-triazol-3-ylbenzamide, alcohol carboxylic acid ester and others, that are heavy metal deactivators, are exemplified. As (F) the lubricant, for example, fatty acid amide system, zinc stearate, silicone, hydrocarbon system, ester system, alcohol system, metal soap system and others are exemplified. As (G) the colorant, for example, carbon black, inorganic pigment, organic pigment, dye and others are exemplified.

As described later in the working examples, the resin composition of the present embodiment contains (B) the flame retardant, a content of which is more than 40 parts by mass and equal to or less than 80 parts by mass per 100 parts by mass of (A) the base polymer. When the addition amount of (B) the flame retardant is equal to or less than 40 parts by mass per 100 parts by mass of (A) the base polymer, the sufficient flame retardancy cannot be obtained. On the other hand, when the addition amount of (B) the flame retardant is more than 80 parts by mass per 100 parts by mass of (A) the base polymer, the flexibility becomes low.

As described later in the working examples, the resin composition of the present embodiment contains (B1) the aluminum hydroxide, a surface of which is treated with a silane coupling agent and a content of which is equal to or more than 10 parts by mass and equal to or less than 70 parts by mass per 100 pars by mass of (B) the flame retardant. When a content of (B1) the aluminum hydroxide, a surface of which is treated with a silane coupling agent, is less than 10 parts by mass per 100 pars by mass of (B) the flame retardant, the whitening resistance in the uncross-linked state becomes low. On the other hand, when the content of (B1) the aluminum hydroxide, a surface of which is treated with a silane coupling agent, is more than 70 parts by mass per 100 pars by mass of (B) the flame retardant, the flexibility becomes low. As the resin composition according to an embodiment of the present invention, a non-halogen resin composition not containing a halogen element is preferable.

<Configuration of Insulated Electric Wire>

FIG. 1 is a horizontal cross-sectional view showing the insulated electric wire (electric wire) according to the embodiment of the present invention. As shown in FIG. 1, an insulated electric wire 10 according to the present embodiment includes a conductor 1 and an insulating layer 2 arranged in periphery of the conductor 1. The insulating layer 2 is made of the resin composition of the present embodiment.

As the conductor 1, a generally-used metallic wire such as a copper wire, a copper alloy wire, an aluminum wire, a gold wire and a silver wire can be used. Alternatively, as the conductor 1, a metallic wire, periphery of which is metallic-plated with tin, nickel or others, may be used. Further, as the conductor 1, a stranded conductor formed by intertwining metallic wires may be also used.

As shown in FIG. 1, in the insulated electric wire 10 of the present embodiment, it is preferable not to arrange a separator (to provide separator-less) between the conductor 1 and the insulating layer 2 in a viewpoint of reduction in a manufacturing cost and efficiency of a wiring operation. However, the present invention is not limited to this.

A cable of the present embodiment includes a sheath layer in an outer periphery of the insulating layer. In this case, in a viewpoint of prevention of the cable from being scratched and whitened during manufacturing steps, at least the sheath layer that is an outermost layer (a top layer) is preferable to be made of the resin composition of the present embodiment. In this case, a blend composition of the insulating layer is not particularly limited. However, the insulating layer is preferable to be made of the resin composition of the present embodiment.

The insulated electric wire 10 of the present embodiment is applicable to various intended uses and various sizes, and can be used for each electric wire for use in a railroad vehicle, a car, an in-board wiring, an in-device wiring, and electricity. Particularly, the insulated electric wire 10 of the present embodiment is effective to be used as an in-board wiring of a distribution board/control board or a motor lead wire, and besides, effective to an intended use that needs a wiring operability in a narrow space (narrow-space wiring capability) and effective as an electric wire having high possibility of direct touching of a person.

<Method of Manufacturing Insulated Electric Wire>

First, an apparatus that manufactures the insulate electric wire of the present embodiment will be described. FIG. 2 is a schematic view showing an extrusion coating apparatus that manufactures an insulate electric wire of an embodiment of the present invention.

An extrusion coating apparatus 21 according to the present embodiment is, for example, a single screw extruder (L/D=20) having a screw diameter of 65 mm. The extrusion coating apparatus 21 includes a hopper 22 that loads a pellet of the resin composition, a cylinder 28 that heats the resin composition, a screw 23 that extrudes the resin composition in the cylinder 28, and a breaker plate 24 that regulates flow of the resin composition to increase a back pressure for improving a kneading state. Further, the extrusion coating apparatus 21 includes a head 25 that coats the resin composition in periphery of the conductor 1, a neck 26 that connects the cylinder 28 and the head 25, and a die 27 that defines a diameter of the electric wire. The screw 23 has a full flight shape. The cylinder 28 is divided into five cylinders, and is referred to below as cylinders 1 to 5 (not illustrated, see FIG. 1) in an order from the hopper 22 side.

An electron-beam irradiation apparatus according to the present embodiment includes an electron-beam irradiation unit and a pulley for use in guiding the insulated electric wire (illustration of the electron-beam irradiation apparatus is omitted).

Next, a method of manufacturing the insulated electric wire 10 of the present embodiment will be described. First, for example, (A) the base polymer and (B) the flame retardant are kneaded by a kneader, and, for example, a pellet-shaped resin composition (compound) is formed (at a kneading step).

Subsequently, by the extrusion coating apparatus 21 shown in FIG. 2, for example, the pellet of the resin composition is loaded into the hopper 22. Then, the resin composition is extruded so as to coat the periphery of the conductor 1 to form the insulating layer 2 having a predetermined thickness (at an insulating-layer coating step). In this manner, an uncross-linked insulated electric wire 5 is manufactured. Note that the manufactured uncross-linked insulated electric wire 5 is temporarily stored so that the insulated electric wire is reeled up onto the drum 29.

Subsequently, the uncross-linked insulated electric wire 5 is reeled out of the drum 29 by the electron-beam irradiation apparatus, and is guided and loaded into the electron-beam irradiation unit by the pulley. Then, in the electron-beam irradiation unit, the uncross-linked insulated electric wire 5 is irradiated with electron beams (at a cross-linking step). In this manner, (A) the base polymer in the resin composition making up the insulating layer 2 of the uncross-linked insulated electric wire 5 is cross-linked, so that a cross-linked insulated electric wire 10 can be manufactured. Note that the cross-linked insulated electric wire 10 is, for example, guided by the pulley and reeled up onto the drum. By the above-described steps, the insulated electric wire 10 of the present embodiment can be manufactured.

Regarding the insulated electric wire 10 of the present embodiment, note that the case of the cross linking using the electron-beam irradiation method has been described as one example. However, the invention is not limited to this example. For example, a chemical cross linking method may be applied, the method manufacturing the cross-linked insulated electric wire 10 by manufacturing the uncross-linked insulated electric wire 5 with a cross linker being previously added to the resin composition, and then, performing a thermal treatment for the cross linking. That is, the resin composition of the present embodiment can be preferably used as a material of the insulating layer of the insulated electric wire (the sheath layer in the case of the cable) that is manufactured by manufacturing steps including a step of generating an external force such as bending force or friction force applied to the uncross-linked insulated electric wire 5, such as the step of reeling up the uncross-linked insulated electric wire 5 onto the drum before the cross linking.

The kneading apparatus for use in manufacturing the resin composition of the present embodiment is not limited to the kneader, and a publicly-known kneading apparatus such as a batch-type kneader such as a Banbury mixer or a continuous-type kneader such as a twin-screw extruder can be adopted.

<Feature and Effect of Present Embodiment>

The resin composition according to an embodiment of the present invention contains (A) the base polymer and (B) the flame retardant. The (A) base polymer contains (A1) the polymer having the polar group. The (B) flame retardant of the present embodiment is made of (B1) the aluminum hydroxide, a surface of which is treated with a silane coupling agent, (B2) the aluminum hydroxide, a surface of which is treated with a treatment agent other than the silane coupling agent and/or (B3) the aluminum hydroxide, a surface of which is untreated. The resin composition according to the present embodiment contains the (B) flame retardant, a content of which is more than 40 parts by mass and equal to or less than 80 parts by mass per 100 parts by mass of the (A) the base polymer. The resin composition according to the present embodiment contains (B1) the aluminum hydroxide, a surface of which is treated with a silane coupling agent and a content of which is equal to or more than 10 parts by mass and equal to or less than 70 parts by mass per 100 parts by mass of (B) the flame retardant.

As shown in FIG. 1, the insulated electric wire 10 according to an embodiment of the present invention includes the conductor 1 and the insulating layer 2 coated in the periphery of the conductor 1, and the insulating layer 2 is made of the above-described resin composition of the present embodiment.

The method of manufacturing the insulated electric wire according to the present embodiment includes (a) the step of forming the resin composition by kneading the base polymer and the flame retardant, (b) the step of manufacturing the uncross-linked insulated electric wire by extruding the resin composition so as to coat the periphery of the conductor to form the insulating layer, and (c) the step of manufacturing the cross-linked insulated electric wire by cross-linking the base polymer in the resin composition. The resin composition formed in the step (a) is the above-described resin composition of the present embodiment.

By applying the configurations and the steps as described above, the present invention can provide the resin composition and the insulated electric wire each of which has the excellent whitening resistance, flame retardancy and flexibility in the uncross-linked state. A reason for this will be specifically described below.

As described above, when the post cross linking mode is applied so that it is unnecessary to arrange the separator between the conductor and the insulating layer, it is necessary to reel up the uncross-linked insulated electric wire onto the drum or others, and the electric wire is scratched or whitened at this time. As a result, a problem that is degradation of the outer appearance of the insulated electric wire arises. In this case, it is considered that the whitening phenomenon are caused by peeling off on an interface between the resin (base polymer) to be the base material and the filler (such as the flame retardant) that disperses in the resin caused when the external force such as the bending or the friction force is applied to the material. Therefore, for the suppression of the whitening phenomenon, it is considered that adhesiveness between the resin and the filler is important.

Regarding this point, the resin composition according to an embodiment of the present invention contains (A1) the polymer having the polar group as (A) the base polymer, and (B1) the aluminum hydroxide, a surface of which is treated with a silane coupling agent as (B) the flame retardant. The (B1) aluminum hydroxide, a surface of which is treated with a silane coupling agent, has an affinity for (A1) the polymer having the polar group, and therefore, the adhesiveness between (A) the base polymer and (B) the flame retardant can be enhanced. As a result, since the insulated electric wire of the present embodiment has the insulating layer made of this resin composition, the electric wire can be prevented from being scratched or whitened even when the surface of the uncross-linked insulated electric wire 5 chafes against the drum 29 shown in FIG. 2 or a tool such as the pulley for use in reeling out the insulated electric wire 5 or even when the insulated electric wires 5 chafe against one another.

As described above, in the individual use of (B1) the aluminum hydroxide, a surface of which is treated with a silane coupling agent, the flexibility of the insulating layer of the insulated electric wire is reduced because of the too high affinity for (A1) the polymer having the polar group. Therefore, according to the present embodiment, (B) the flame retardant is configured so as to include not only (B1) the aluminum hydroxide, a surface of which is treated with a silane coupling agent, but also (B2) the aluminum hydroxide, a surface of which is treated with a treatment agent other than the silane coupling agent, and/or (B3) the aluminum hydroxide, a surface of which is untreated. In this manner, the resin composition of the present embodiment can enhance the adhesiveness between (A) the base polymer and (B) the flame retardant while ensuring the flame retardancy and the flexibility of the insulating layer of the insulated electric wire.

In the above-described manner, the resin composition and the insulated electric wire of the present embodiment can provide the whitening resistance in the uncross-linked state, and, at the same time, can ensure the flame retardancy and the flexibility of the insulating layer of the insulated electric wire that are required for use in, for example, an in-board wiring of a distribution board/control board, a motor lead wire or others.

WORKING EXAMPLES

The present invention will be described in more details below on the basis of the working examples. However, the present invention is not limited to be applied to these working examples.

Each of insulated electric wires of working examples 1 to 12 and comparative examples 1 to 7 described below was configured as the insulated electric wire having the same configuration as that of the insulated electric wire 10 shown in FIG. 1, and corresponds to the one having a changed blend of the resin composition making up the insulating layer 2. As the conductor 1, a tin-plated copper stranded wire (having a cross-sectional area of 2 $mm^2$) was used. The insulating layer 2 in each of the working examples 1 to 12 was made of a resin composition having a blend shown in each of later-described tables 2 and 4, and the insulating layer in each of the comparative examples 1 to 7 was made of the same shown in a later-described table 3.

Raw Materials of Working Examples 1 to 12 and Comparative Examples 1 to 7

The raw materials for use in the working examples 1 to 12 and the comparative examples 1 to 7 are shown in the later-described tables 2 to 4, and are only summarized below.

(A) Base Polymer:

(A1) Polymer having Polar Group: ethylene-vinyl acetate copolymer (A2) Other Polymer: ethylene-butene copolymer, ethylene-octene copolymer (B) Flame Retardant:

(B1) Aluminum Hydroxide, a surface of which is treated with a silane coupling agent (abbreviated as "silane treated" in the table 2 and 3)

(B2) Aluminum Hydroxide, a surface of which is treated with a fatty acid (abbreviated as "fatty-acid-treated" in the table 2 and 3)

(B3) Aluminum Hydroxide, a surface of which is untreated (abbreviated as "untreated" in the table 2 and 3)

(C) Cross-Linking Aid: trimethylolpropane trimethacrylate (D) Antioxidant:

(D1) Phenol-based Antioxidant (D2) Sulfur-based Antioxidant (E) Copper Inhibitor: heavy metal deactivator (F) Lubricant: amide-based lubricant (G) Colorant:

(G1) Carbon Black (G2) (Yellow) Color Masterbatch (G3) (Green) Color Masterbatch

Manufacturing Methods of Working Examples 1 to 12 and Comparative Examples 1 to 7

Each sample of the working examples 1 to 12 and the comparative examples 1 to 7 was manufactured by the following method. In the table 1, note that the kneading condition of the single-screw extruder in each of the working examples 1 to 12 and the comparative examples 1 to 7 is summarized.

TABLE 1

| Classification | Item | Setting |
|---|---|---|
| Extruder | Size | 65-mm single screw |
| | L/D | 20 |
| Temperature (° C.) | Cylinder 1 (Hopper side) | 120 |
| | Cylinder 2 | 125 |
| | Cylinder 3 | 130 |
| | Cylinder 4 | 135 |
| | Cylinder 5 | 140 |
| | Neck | 160 |
| | Cross head | 160 |
| | Die | 160 |
| Screw | Rotational speed (rpm) | 30 |
| | Shape | Full flight type |
| Reeling out | Reeling-out speed (m/min) | 50 |

A compound was manufactured by kneading the raw materials of each of the working examples 1 to 12 and the comparative examples 1 to 7 shown in the later-described tables 2 and 3 in a kneader having an internal capacity of 25 L and was shaped into a pellet. The resin composition was extruded so as to coat the periphery of the conductor (tin-plated copper stranded wire) under the condition shown in the table 1 by using a single-screw extruder (corresponding to the extrusion coating apparatus 21 shown in FIG. 2) having a screw diameter of 65 mm, and an insulating layer having a coating thickness of about 1 mm was formed, so that the uncross-linked insulated electric wire (corresponding to the insulated electric wire 5 shown in FIG. 2) was manufactured. The manufactured uncross-linked insulated electric wire was temporarily reeled up on the drum (corresponding to the drum 29 shown in FIG. 2).

Next, in the electron-beam irradiation apparatus, the uncross-linked insulated electric wire was reeled out of the drum, and was irradiated with the electron beams (having an acceleration voltage of 2 MV and an electron-beam irradiance level of 10 Mrad), so that the cross-linked insulated electric wire (corresponding to the insulated electric wire 10 shown in FIG. 1) was manufactured.

Evaluating Method for Working Examples 1 to 12 and Comparative Examples 1 to 7

An evaluating method for the working examples 1 to 12 and the comparative examples 1 to 7 will be described below. Evaluated items (1) to (3) described below were comprehensively determined so that a sample that passed all the evaluated items was evaluated as "○" (passed) while a sample that failed even one item was evaluated as "X" (failed), and the samples were shown in the later-described tables 2 and 3.

(1) Whitening by Friction

The whitening by friction at the time of the manufacture of the electric wire was evaluated by visual observation of the surface of the uncross-linked insulated electric wire reeled up on the drum (corresponding to the uncross-linked insulated electric wire 5 reeled up on the drum 29 shown in FIG. 2). A sample in which the whitening phenomenon was not observed was evaluated as "◎", a sample in which the whitening phenomenon was slightly observed but was not a problem on a product appearance was evaluated as "○", a sample in which the whitening phenomenon was observed to be a problem on the product appearance was evaluated as "X", and the samples evaluated as "◎" and "○" were classified as "passed" while the samples evaluated as "X" were classified as "failed".

(2) Oxygen Index (Flame Retardancy)

The above-described compound was shaped into a sheet piece having a thickness of 3 mm by using a thermal pressing machine at 160° C. This sheet piece was irradiated with the electron beams having the same condition (an acceleration voltage of 2 MV and an electron-beam irradiation level of 10 Mrad) as that of the electric-wire cross linking step by using the electron-beam irradiation apparatus, so that a cross-linked sheet piece was manufactured. Then, an oxygen index of this cross-linked sheet piece was measured by a method using an OXYGEN INDEXER (produced by Toyo Seiki Co., Ltd.) and defined in JIS K7201-2 (2007). A sample having an oxygen index that is equal to or larger than 20 was evaluated as a sample having sufficient flame retardancy to be "○" (passed) while a sample having an oxygen index that is smaller than 20 was evaluated as a sample having insufficient flame retardancy to be as "X" (failed).

(3) Tensile Strength in 100% Tension (Flexibility)

A conductor was pulled out of the cross-linked electric wire, and was cut to have a length of 150 mm, and a tubular test piece having gauge lines with a 50-mm gap therebetween at a center was prepared. A tensile load was measured when 100% tension between the gauge lines of this tubular test piece was performed under a condition of a tensile speed of 200 mm/min., by using a Schopper tensile strength tester, and a tensile strength was calculated from the following expression 1. A sample having a tensile strength in 100% tension that is equal to or smaller than 6.0 MPa was evaluated as a sample having sufficient flexibility to be "○" (passed) while a sample having a tensile strength in 100% tension that is larger than 6.0 MPa was evaluated as a sample having insufficient flexibility to be "X" (failed).

$$\delta = F/A \quad (\delta\text{: tensile strength [MPa]}, F\text{: tensile load [}N\text{]}, A\text{: test-piece cross-sectional area [mm}^2\text{]}) \qquad \text{(Expression 1)}$$

Evaluating Results of Working Examples 1 to 12 and Comparative Examples 1 to 7

Evaluating results based on the above-described evaluating method are summarized in the tables 2 and 3.

TABLE 2

| Blend | | | Working example 1 | Working example 2 | Working example 3 | Working example 4 |
|---|---|---|---|---|---|---|
| (A) Base polymer | (A1) Polymer having polar group | (A1) Ethylene-vinyl acetate copolymer (VA amount 15 wt. %) *1 | 40 | 40 | 40 | 40 |
| | | (A1) Ethylene-vinyl acetate copolymer (VA amount 28 wt. %) *2 | 20 | 20 | 20 | 20 |
| | (A2) Other polymer | (A2) Ethylene-butane copolymer *3 | 40 | 40 | 40 | 40 |
| | | (A2) Ethylene-octane copolymer *4 | | | | |
| (B) Flame retardant | (B) Aluminum hydroxide | (B1) Silane treated | 8 | 24 | 40 | 56 |
| | | (B2) Fatty-acid treated | 72 | 56 | 40 | 24 |
| | | (B3) Untreated | | | | |
| Other components | (C) Cross lining aid | trimethylolpropane trimethacrylate | 2 | 2 | 2 | 2 |
| | (D) Antioxidant | (D1) Phenol-based antioxidant | 0.6 | 0.6 | 0.6 | 0.6 |
| | | (D2) Sulfur-based antioxidant | 1.2 | 1.2 | 1.2 | 1.2 |
| | (E) Copper inhibitor | Heavy metal deactivator | 0.5 | 0.5 | 0.5 | 0.5 |
| | (F) Lubricant | Amide-based lubricant | 1 | 1 | 1 | 1 |
| | (G) Colorant | (G1) Carbon black *5 | 5 | 5 | 5 | 5 |
| | | (G1) (Yellow) color masterbatch *6 | | | | |
| | | (G3) (Green) color masterbatch *7 | | | | |
| Blend ratio | Ratio of (B) Frame retardant per 100 parts by mass of (A) Base polymer | | 80 | 80 | 80 | 80 |
| | Ratio of (B1) Silane-treated aluminum hydroxide per 100 parts by mass of (B) Flame retardant | | 10 | 10 | 10 | 10 |

TABLE 2-continued

| | | | | | | |
|---|---|---|---|---|---|---|
| Evaluation | Property | (1) Whitening by Friction on Uncross-linked Electric Wire Surface after Reeling Up on Drum | ○ (slightly) observed) | ◎ (not observed) | ◎ (not observed) | ◎ (not observed) |
| | | (2) Oxygen index (Evaluation on sheet) | ○ (24.0) | ○ (23.9) | ○ (23.7) | ○ (23.9) |
| | | (3) Tensile strength in 100% Tension (MPa) | ○ (4.3) | ○ (4.8) | ○ (5.5) | ○ (5.9) |
| | Determination | | ○ | ○ | ○ | ○ |

| | Blend | | | Working example 5 | Working example 6 | Working example 7 | Working example 8 |
|---|---|---|---|---|---|---|---|
| | (A) Base polymer | (A1) Polymer having polar group | (A1) Ethylene-vinyl acetate copolymer (VA amount 15 wt. %) *1 | 40 | 40 | 40 | 40 |
| | | | (A1) Ethylene-vinyl acetate copolymer (VA amount 28 wt. %) *2 | 20 | 20 | 20 | 20 |
| | | (A2) Other polymer | (A2) Ethylene-butane copolymer *3 | 40 | 40 | 40 | 40 |
| | | | (A2) Ethylene-octane copolymer *4 | | | | |
| | (B) Flame retardant | (B) Aluminum hydroxide | (B1) Silane treated | 6 | 8 | 8 | 8 |
| | | | (B2) Fatty-acid treated | 54 | | 72 | 72 |
| | | | (B3) Untreated | | 72 | | |
| | Other components | (C) Cross lining aid | trimethylolpropane trimethacrylate | 2 | 2 | 2 | 2 |
| | | (D) Antioxidant | (D1) Phenol-based antioxidant | 0.6 | 0.6 | 0.6 | 0.6 |
| | | | (D2) Sulfur-based antioxidant | 1.2 | 1.2 | 1.2 | 1.2 |
| | | (E) Copper inhibitor | Heavy metal deactivator | 0.5 | 0.5 | 0.5 | 0.5 |
| | | (F) Lubricant | Amide-based lubricant | 1 | 1 | 1 | 1 |
| | | (G) Colorant | (G1) Carbon black *5 | 5 | 5 | | |
| | | | (G1) (Yellow) color masterbatch *6 | | | 5 | |
| | | | (G3) (Green) color masterbatch *7 | | | | 5 |
| | Blend ratio | Ratio of (B) Frame retardant per 100 parts by mass of (A) Base polymer | | 80 | 80 | 80 | 80 |
| | | Ratio of (B1) Silane-treated aluminum hydroxide per 100 parts by mass of (B) Flame retardant | | 10 | 10 | 10 | 10 |
| Evaluation | Property | (1) Whitening by Friction on Uncross-linked Electric Wire Surface after Reeling Up on Drum | | ◎ (not observed) | ○ (slightly observed) | ◎ (not observed) | ◎ (not observed) |
| | | (2) Oxygen index (Evaluation on sheet) | | ○ (21.8) | ○ (24.1) | ○ (23.7) | ○ (23.8) |
| | | (3) Tensile strength in 100% Tension (MPa) | | ○ (3.8) | ○ (4.6) | ○ (4.1) | ○ (4.0) |
| | Determination | | | ○ | ○ | ○ | ○ |

*1 MFR (g/10 min@190° C., 2.16 kgf): 0.8, Melting point: 89° C.
*2 MFR (g/10 min@190° C., 2.16 kgf): 6.0, Melting point: 72° C.
*3 MFR (g/10 min@190° C., 2.16 kgf): 3.6, Melting point: 66° C.
*4 MFR (g/10 min@190° C., 2.16 kgf): 0.5, Melting point: 49° C.
*5 Thermal carbon, Average Particle Diameter: 80 nm
*6 Masterbatch blended with Condensed Azo-base Pigment
*7 Masterbatch blended with Phthalocyanine-Blue- and Monoazo-Yellow-base Pigment Mixture

TABLE 3

| Blend | | | Comparative example 1 | Comparative example 2 | Comparative example 3 | Comparative example 4 |
|---|---|---|---|---|---|---|
| (A) Base polymer | (A1) Polymer having polar group | (A1) Ethylene-vinyl acetate copolmer (VA amount 15 wt. %) *1 | 40 | 40 | 40 | 40 |
| | | (A1) Ethylene-vinyl acetate copolymer (VA amount 28 wt. %) *2 | 20 | 20 | 20 | 20 |
| | (A2) Other polymer | (A2) Ethylene-butane copolymer *3 | 40 | 40 | 40 | 40 |
| | | (A2) Ethylene-octane copolymer *4 | | | | |

TABLE 3-continued

| | | | | | | | |
|---|---|---|---|---|---|---|---|
| | (B) Flame retardant | (B) Aluminum hydroxide | (B1) Silane treated | | 4 | 64 | 4 |
| | | | (B2) Fatty-acid treated | 80 | 76 | 16 | 36 |
| | | | (B3) Untreated | | | | |
| | Other components | (C) Cross lining aid | trimethylolpropane trimethacrylate | 2 | 2 | 2 | 2 |
| | | (D) Antioxidant | (D1) Phenol-based antioxidant | 0.6 | 0.6 | 0.6 | 0.6 |
| | | | (D2) Sulfur-based antioxidant | 1.2 | 1.2 | 1.2 | 1.2 |
| | | (E) Copper inhibitor | Heavy metal deactivator | 0.5 | 0.5 | 0.5 | 0.5 |
| | | (F) Lubricant | Amide-based lubricant | 1 | 1 | 1 | 1 |
| | | (G) Colorant | (G1) Carbon black *5 | 5 | 5 | 5 | 5 |
| | | | (G2) (Yellow) color masterbatch *6 | | | | |
| | | | (G3) (Green) color masterbatch *7 | | | | |
| | Blend ratio | Ratio of (B) Flame retardant per 100 parts by mass of (A) Base polymer | | 80 | 80 | 80 | 40 |
| | | Ratio of (B1) Silane-treated aluminum hydroxide per 100 parts by mass of (B) Flame retardent | | 0 | 5 | 80 | 10 |
| Evaluation | Property | (1) Whitening by Friction on Uncross-linked Electric Wire Surface after Reeling Up on Drum | | X (observed) | X (observed) | ◎ (not observed) | ◎ (not observed) |
| | | (2) Oxygen index (Evaluation on sheet) | | ○ (23.6) | ○ (23.8) | ○ (23.8) | X (19.8) |
| | | (3) Tensile strength in 100% Tensile (MPa) | | ○ (3.6) | ○ (3.9) | X (6.6) | ○ (3.1) |
| | Determination | | | X | X | X | X |

| | | | Blend | | Comparative example 5 | Comparative example 6 | Comparative example 7 |
|---|---|---|---|---|---|---|---|
| | | (A) Base polymer | (A1) Polymer having polar group | (A1) Ethylene-vinyl acetate copolmer (VA amount 15 wt. %) *1 | 40 | 40 | |
| | | | | (A1) Ethylene-vinyl acetate copolymer (VA amount 28 wt. %) *2 | 20 | 20 | |
| | | | (A2) Other polymer | (A2) Ethylene-butane copolymer *3 | 40 | 40 | 40 |
| | | | | (A2) Ethylene-octane copolymer *4 | | | 40 |
| | | (B) Flame retardant | (B) Aluminum hydroxide | (B1) Silane treated | 3 | 2 | 8 |
| | | | | (B2) Fatty-acid treated | 57 | 38 | 72 |
| | | | | (B3) Untreated | | | |
| | | Other components | (C) Cross lining aid | trimethylolpropane trimethacrylate | 2 | 2 | 2 |
| | | | (D) Antioxidant | (D1) Phenol-based antioxidant | 0.6 | 0.6 | 0.6 |
| | | | | (D2) Sulfur-based antioxidant | 1.2 | 1.2 | 1.2 |
| | | | (E) Copper inhibitor | Heavy metal deactivator | 0.5 | 0.5 | 0.5 |
| | | | (F) Lubricant | Amide-based lubricant | 1 | 1 | 1 |
| | | | (G) Colorant | (G1) Carbon black *5 | 5 | 5 | 5 |
| | | | | (G2) (Yellow) color masterbatch *6 | | | |
| | | | | (G3) (Green) color masterbatch *7 | | | |
| | | Blend ratio | Ratio of (B) Flame retardant per 100 parts by mass of (A) Base polymer | | 60 | 40 | 80 |
| | | | Ratio of (B1) Silane-treated aluminum hydroxide per 100 parts by mass of (B) Flame retardent | | 5 | 5 | 10 |
| | Evaluation | Property | (1) Whitening by Friction on Uncross-linked Electric Wire Surface after Reeling Up on Drum | | X (observed) | ○ (slightly observed) | X (observed) |
| | | | (2) Oxygen index (Evaluation on sheet) | | ○ (21.5) | X (19.6) | ○ (22.1) |

TABLE 3-continued

| | | | | | |
|---|---|---|---|---|---|
| | (3) Tensile strength in 100% Tensile (MPa) | ○ (3.1) | ○ (3.0) | ○ (2.9) |
| | Determination | X | X | X |

*1 MFR (g/10 min@190° C., 2.16 kgf): 0.8, Melting point: 89° C.
*2 MFR (g/10 min@190° C., 2.16 kgf): 6.0, Melting point: 72° C.
*3 MFR (g/10 min@190° C., 2.16 kgf): 3.6, Melting point: 66° C.
*4 MFR (g/10 min@190° C., 2.16 kgf): 0.5, Melting point: 49° C.
*5 Thermal carbon, Average Particle Diameter: 80 nm
*6 Masterbatch blended with Condensed Azo-base Pigment
*7 Masterbatch blended with Phthalocyanine-Blue- and Monoazo-Yellow-base Pigment Mixture
PGPubs, use the Gap Bulletin per PTO.

TABLE 4

| | Blend | | | Working example 9 | Working example 10 | Working example 11 | Working example 12 |
|---|---|---|---|---|---|---|---|
| | (A) Base polymer | (A1) Polymer having polar group | (A1) Ethylene-vinyl acetate copolmer (VA amount 15 wt. %) *1 | 40 | 40 | 40 | 40 |
| | | | (A1) Ethylene-vinyl acetate copolymer (VA amount 28 wt. %) *2 | 20 | 20 | 20 | 20 |
| | | (A2) Other polymer | (A2) Ethylene-butane copolymer *3 | 40 | 40 | 40 | 40 |
| | | | (A2) Ethylene-octane copolymer *4 | | | | |
| | (B) Flame retardant | (B) Aluminum hydroxide | (B1) Silane treated | 8 | 8 | 8 | 8 |
| | | | (B2) Fatty-acid treated | 72 | 72 | 72 | 72 |
| | | | (B3) Untreated | | | | |
| | Other components | (C) Cross lining aid | trimethylolpropane trimethacrylate | 2 | 2 | 2 | 2 |
| | | (D) Antioxidant | (D1) Phenol-based antioxidant | 0.6 | 0.6 | 0.6 | 0.6 |
| | | | (D2) Sulfur-based antioxidant | 1.2 | 1.2 | 1.2 | 1.2 |
| | | (E) Copper inhibitor | Heavy metal deactivator | 0.5 | 0.5 | 0.5 | 0.5 |
| | | (F) Lubricant | Amide-based lubricant | 1 | 1 | 1 | 1 |
| | | (G) Colorant | (G1) (White) color masterbatch *5 | | 5 | | |
| | | | (G2) (Red) color masterbatch *6 | | | 5 | |
| | | | (G3) (Black) color masterbatch *7 | | | | 5 |
| | Blend ratio | Ratio of (B) Flame retardant per 100 parts by mass of (A) Base polymer | | 80 | 80 | 80 | 80 |
| | | Ratio of (B1) Silane-treated aluminum hydroxide per 100 parts by mass of (B) Flame retardent | | 10 | 10 | 10 | 10 |
| Evaluation | Property | (1) Whitening by Friction on Uncross-linked Electric Wire | | ◎ | ◎ | ◎ | ◎ |
| | | Surface after Reeling Up on Drum | | (not observed) | (not observed) | (not observed) | (not observed) |
| | | (2) Oxygen index (Evaluation on sheet) | | ○ (23.3) | ○ (23.9) | ○ (23.7) | ○ (23.9) |
| | | (3) Tensile strength in 100% Tensile (MPa) | | ○ (3.8) | ○ (4.2) | ○ (4.0) | ○ (4.2) |
| | Determination | | | ○ | ○ | ○ | ○ |

*1 MFR (g/10 min@190° C., 2.16 kgf): 0.8, Melting point: 89° C.
*2 MFR (g/10 min@190° C., 2.16 kgf): 6.0, Melting point: 72° C.
*3 MFR (g/10 min@190° C., 2.16 kgf): 3.6, Melting point: 66° C.
*4 MFR (g/10 min@190° C., 2.16 kgf): 0.5, Melting point: 49° C.
*5 Masterbatch blended with Titanium Oxide, produced by Dainichiseika Color & Chemicals Mfg. Co., Ltd.
*6 Masterbatch blended with Mono-Azo-Red- and Quinacridone-Red-base Pigment, produced by Dainichiseika Color & Chemicals Mfg. Co., Ltd.
*7 Masterbatch blended with Carbon Black, produced by Toyo Ink Co., Ltd.

As shown in the tables 2 and 4, the working examples 1 to 12 passed all (1) the fraction whitening property, (2) the oxygen index (flame retardancy) and (3) the tensile strength in 100% tension (flexibility), and were evaluated as "○" (passed). On the other hand, as shown in the table 3, the comparative examples 1 to 7 were evaluated as "X" (failed). Specifically, the comparative examples 1, 2, 5 and 7 failed (1) the fraction whitening property, the comparative examples 4 and 6 failed (2) the oxygen index (flame retardancy), and the comparative example 3 failed (3) the tensile strength in 100% tension (flexibility).

Each sample of the working examples 1 to 12 contains (A1) the polymer having the polar group as (A) the base polymer, contains (B) the flame retardant, a content of which is more than 40 parts by mass and equal to or less than 80 parts by mass per 100 parts by mass of (A) the base polymer, and contains (B1) the aluminum hydroxide, a surface of which is treated with a silane coupling agent and a content of which is equal to or more than 10 parts by mass and equal to or less than 70 parts by mass per 100 parts by mass of (B) the flame retardant. In this manner, it has been found that the resin composition having the excellent whitening resistance, flame retardancy and flexibility in the uncross-linked state can be obtained. It has been found that, when the insulating layer of the insulated electric wire is made of this resin composition, the insulated electric wire having the excellent whitening resistance, flame retardancy and flexibility in the uncross-linked state can be obtained. And, it has been found that the insulated electric wire having the excellent whitening resistance, flame retardancy and flexibility in the uncross-linked state can be manufactured by the method of manufacturing the insulated electric wire according to the present embodiment.

More specifically, from the results of the working examples 1 to 12 and the comparative examples 1, 2, 5 and 7, it has been found that, in order to meet the requirement of the whitening resistance, it is necessary that the resin composition should contain (B1) the aluminum hydroxide, a surface of which is treated with a silane coupling agent and a content of which is equal to or more than 10 parts by mass per 100 parts by mass of (B) the flame retardant, and contain (A1) the polymer having the polar group as (A) the base polymer.

Particularly, as shown in the comparative example 7, it has been found as follow. Even when (B1) the aluminum hydroxide, a surface of which is treated with a silane coupling agent, is used, if (A) the base polymer does not contain (A1) the polymer having the polar group, the requirement of the whitening resistance cannot be met. As shown in the comparative example 1, it has been found that the requirement of the whitening resistance cannot be met even when (B2) the aluminum hydroxide, a surface of which is treated with a fatty acid, is used instead of (B1) the aluminum hydroxide, a surface of which is treated with a silane coupling agent.

As shown in the comparative example 6, note that it has been found as follow. When the content of (B) the flame retardant of the resin composition is less than 40 parts by mass, even if the content of (B1) the aluminum hydroxide, a surface of which is treated with a silane coupling agent, is not equal to or more than 10 parts by mass per 100 parts by mass of (B) the flame retardant, the sample passes the whitening resistance test.

From the results of the working examples 1 to 12 and the comparative examples 4 and 6, it has been found that, in order to meet the requirement of the flame retardancy, it is necessary that the resin composition should contain (B) the flame retardant, a content of which is more than 40 parts by mass per 100 parts by mass of (A) the base polymer.

From the results of the working examples 1 to 12 and the comparative example 3, it has been found that, in order to meet the requirement of the flexibility, it is necessary that the resin composition should contain (B1) the aluminum hydroxide, a surface of which is treated with a silane coupling agent and a content of which is less than 70 parts by mass per 100 parts by mass of (B) the flame retardant.

Meanwhile, from the results of the working examples 1 and 6, it has been found that the resin composition may contain not only (B1) the aluminum hydroxide, a surface of which is treated with a silane coupling agent, but also whether (B2) the aluminum hydroxide, a surface of which is treated with a fatty acid or (B3) the aluminum hydroxide, a surface of which is untreated, as the component making up (B) the flame retardant. From this result, it is considered that (B2) the aluminum hydroxide, a surface of which is treated with the fatty acid and (B3) the aluminum hydroxide, a surface of which is untreated, can be blended in an any ratio.

From the results of the working examples 1, 7, 8 and 10 to 12, at least in black-hue, white-hue, red-hue, yellow-hue and green-hue insulating layers of the insulated electric wires, it has been found that the insulated electric wire having the excellent whitening resistance, flame retardancy and flexibility in the uncross-linked state can be manufactured without change in the blend ratio of the materials except for (G) the colorant regardless of a type of (G) the colorant. From the result of the working example 9, it has been found that, even when (G) the colorant is not added, the insulated electric wire having the excellent whitening resistance, flame retardancy and flexibility in the uncross-linked state can be manufactured.

The present invention is not limited to the foregoing embodiments and working examples, and various alterations can be made within the scope of the present invention.

What is claimed is:

1. A resin composition comprising:

a base polymer; and a flame retardant, wherein the flame retardant is made of aluminum hydroxide, a surface of which is treated with a silane coupling agent, and aluminum hydroxide, a surface of which is treated with a fatty acid, the base polymer contains a polymer having a polar group, the resin composition contains the flame retardant, a content of which is more than 40 parts by mass and equal to or less than 80 parts by mass per 100 parts by mass of the base polymer, and the resin composition contains the aluminum hydroxide, a surface of which is treated with the silane coupling agent and a content of which is equal to or more than 10 parts by mass and equal to or less than 70 parts by mass per 100 parts by mass of the flame retardant.

2. The resin composition according to claim 1, wherein the polymer having the polar group is ethylene-vinyl acetate copolymer.

3. The resin composition according to claim 1, wherein the resin composition further contains a black, yellow, white, red or green colorant.

4. An insulated electric wire comprising:

an insulating layer made of the resin composition according to claim 1.

5. A cable comprising:

a sheath layer made of the resin composition according to claim 1.

6. The insulated electric wire according to claim 4, wherein an oxygen index is equal to or larger than 20, and a tensile strength in 100% tension is equal to or smaller than 6.0 MPa.

7. The insulated electric wire according to claim 4, wherein the insulated electric wire is used for an in-board wiring of a distribution board or a control board or for a motor lead wire.

8. A method of manufacturing an insulated electric wire comprising the steps of:

(a) forming a resin composition by kneading a base polymer and a flame retardant;

(b) manufacturing an uncross-linked insulated electric wire by extruding the resin composition so as to coat periphery of a conductor to form an insulating layer; and (c) manufacturing a cross-linked insulated electric wire by cross-linking the base polymer in the resin composition, wherein the flame retardant is made of aluminum hydroxide, a surface of which is treated with a silane coupling agent, and aluminum hydroxide, a surface of which is treated with a fatty acid, the base polymer contains a polymer having a polar group, the resin composition contains the flame retardant, a content of which is more than 40 parts by mass and equal to or less than 80 parts by mass per 100 parts by mass of the base polymer, and the resin composition contains the aluminum hydroxide, a surface of which is treated with the silane coupling agent and a content of which is equal to or more than 10 parts by mass and equal to or less than 70 parts by mass per 100 parts by mass of the flame retardant.

9. The method of manufacturing the insulated electric wire according to claim 8, wherein, after the step (b) and before the step (c), the method includes a step of (d) reeling up the uncross-linked insulated electric wire.

10. The method of manufacturing the insulated electric wire according to claim 8, wherein the cross-linked insulated electric wire has an oxygen index that is equal to or larger than 20, and has a tensile strength in 100% tension that is equal to or smaller than 6.0 MPa.

* * * * *